US006248213B1

(12) United States Patent
Karvinen

(10) Patent No.: US 6,248,213 B1
(45) Date of Patent: Jun. 19, 2001

(54) PROCEDURE FOR WASHING THE FABRICS OF A PAPER MACHINE OR EQUIVALENT

(75) Inventor: Juha Karvinen, Siltakylä (FI)

(73) Assignee: Ecopump Oy, Kotka (FI)

( * ) Notice: Subject to any disclaimer, the term of this patent is extended or adjusted under 35 U.S.C. 154(b) by 0 days.

(21) Appl. No.: 09/402,651

(22) PCT Filed: Apr. 7, 1998

(86) PCT No.: PCT/FI98/00300

§ 371 Date: Dec. 3, 1999

§ 102(e) Date: Dec. 3, 1999

(87) PCT Pub. No.: WO98/45533

PCT Pub. Date: Oct. 15, 1998

(30) Foreign Application Priority Data

Apr. 10, 1997 (FI) ..... 971502

(51) Int. Cl.[7] ..... D21F 1/32

(52) U.S. Cl. ..... 162/199; 162/198; 162/263; 162/272; 162/275

(58) Field of Search ..... 162/199, 198, 162/189, 272, 274, 275, 279, 900, 158, 263, 264; 8/151, 156; 15/320; 134/15, 64 R, 122 R; 700/127, 128, 129

(56) References Cited

U.S. PATENT DOCUMENTS

| | | | | |
|---|---|---|---|---|
| 3,459,633 | * | 8/1969 | West | 162/275 |
| 3,859,163 | * | 1/1975 | Haythornthwaite | 162/198 |
| 4,447,924 | * | 5/1984 | Bolton et al. | 8/151 |
| 5,135,615 | * | 8/1992 | Rokman | 162/263 |
| 5,651,812 | * | 7/1997 | McDermott et al. | 106/2 |

FOREIGN PATENT DOCUMENTS

| | | | | |
|---|---|---|---|---|
| 2061341 | * | 8/1980 | (GB) | 162/199 |
| 96 12064 | | 4/1996 | (WO) | D21F/1/32 |

* cited by examiner

*Primary Examiner*—Stanley S. Silverman
*Assistant Examiner*—Eric Hug
(74) *Attorney, Agent, or Firm*—Birch, Stewart, Kolasch & Birch, LLP

(57) ABSTRACT

A method and apparatus for washing a fabric from a paper machine or equivalent, in which a washing fluid is applied to the fabric. In the procedure, the quantity of washing fluid is removed from the fabric and measured by a measuring device, whereby the measurement of the quantity of washing fluid communicates with a control unit that regulates a washing chemical. The regulation of the dosage of washing chemical is controlled on the basis of date adjusted or programmed on the basis of the liquid washing fluid collected.

20 Claims, 1 Drawing Sheet

PROCEDURE FOR WASHING THE FABRICS OF A PAPER MACHINE OR EQUIVALENT

This application is the national phase under 35 U.S.C. §371 of PCT International Application No. PCT/FI98/00300 which has an International filing date of Apr. 7, 1998, which designated the United States of America.

BACKGROUND OF THE INVENTION

In prior art, procedures are known in which the fabrics used in a paper machine or equivalent, such as wires and/or felts, are washed with various chemicals to extend their service life. The washing is performed either continuously while the machine is running or periodically e.g. during down time.

An essential factor in the washing of the fabrics is the accuracy of dosage of chemicals. If an overdose of chemicals is used, this may have adverse effects on the quality of the paper being produced and/or to the runnability of the paper machine. In addition, the operating costs are increased because the chemicals are relatively expensive. On the other hand, if too small amounts of chemicals are used, the washing result will be impaired.

SUMMARY OF INVENTION

The object of the present invention is to achieve a new type of procedure for the washing of fabrics used in a paper machine or equivalent, designed to avoid the drawbacks of prior-art techniques.

The invention provides numerous significant advantages. The procedure allows accurate optimisation of the amount of the washing chemical being used. The procedure also makes it possible to maximise the service life of the fabric. The fabric retains the desired constitution throughout its useful life, allowing a good runnability of the paper machine to be maintained. By using the arrangement of the invention, the amount of washing chemical need not necessarily be measured at all, but the dosage can be effected based solely on measurements of the liquid removed. The arrangement of the invention makes it possible to the optimise the chemicals costs.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which are given by way of illustration only, and thus are not limitative of the present invention, and wherein:

The FIGURE of the drawing is a schematic view of a paper machine for washing the fabrics system of the invention.

DETAILED DESCRIPTION OF THE INVENTION

Figure 1:
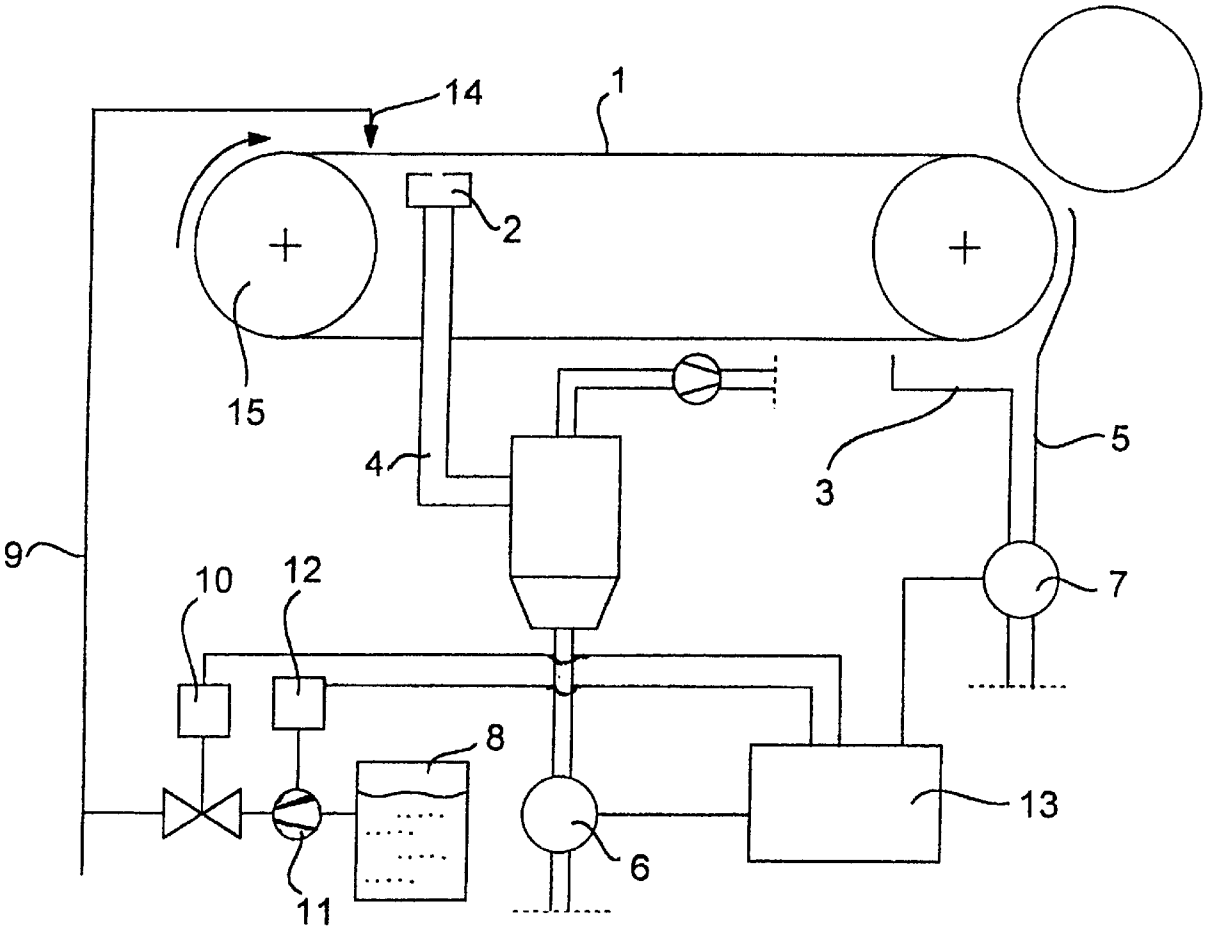

The FIGURE shows a simplified representation of an apparatus in the wire and/or press section of a paper machine or the like. The apparatus comprises at least one set of means 15 for moving a fabric 1, such as a felt or wire. The apparatus comprises liquid removal elements 2, 3, such as suction boxes and/or dewatering troughs and exhaust pipes 4, 5 communicating with them, and measuring devices 6, 7 connected to the dewatering elements for the measurement of the liquid quantity. The amount of liquid removed from the fabric e.g. by means of suction boxes 2 and/or dewatering troughs 3 is measured at at least one point. The supply of washing chemicals is adjusted based on these efflux measurements. The solution presented in the FIGURE comprises a container 8 from where a washing chemical is supplied into at least one pipe 9, from which it is passed onto the fabric 1 to be washed, e.g. using at least one nozzle 14. The regulation of the washing chemical dosage is controlled on the basis of data adjusted or programmed on the basis of the liquid quantity measurements. Regulation can be effected using e.g. a valve element 10 and/or by influencing the operation of a pump 11, e.g. by adjusting the operating speed of the pump motor 12 or using intermittent operation, or in some other way. The control unit 13 used may consist of e.g. a process computer connected to receive the data provided by the measuring devices measuring the amount of liquid removed and to adjust the chemical dosage based on said data.

The apparatus comprises at least one liquid collecting element, such as e.g. a suction pipe 4 having at least one slit over which the fabric 1, such as a felt, wire or equivalent, passes, or a so-called nip water trough 3 into which the water is hurled by centrifugal force. Arranged in conjunction with the suction pipe and/or with the exhaust pipe of the liquid collecting element is a liquid quantity measuring device 6, 7. The measurement data from the measuring devices is transmitted to the control unit 13, which regulates the dosage of the washing chemical to be supplied to the fabric. The chemical dosage is regulated by means of regulating elements, such as valves 10 and/or by regulating the yield of a pump element 11.

It is obvious to the person skilled in the art that the invention is not restricted to the embodiments described above, but that it may be varied within the scope of the following claims.

What is claimed is:

1. A method of washing a fabric in a paper machine comprising the steps of:

applying a quantity of washing fluid to said fabric, said washing fluid having a dosage of a washing chemical therein;

providing at least one liquid removal element;

removing a quantity of said washing fluid from said fabric at least at one point;

providing a measuring device for measuring said quantity of washing fluid removed from said fabric at said at least one point;

obtaining a measurement of said quantity of washing fluid removed from said fabric; and regulating the dosage of the washing chemical provided in said washing fluid based on said measurement of said quantity of washing fluid removed from said fabric.

2. The method according to claim 1, wherein said step of providing at least one liquid removal element comprises at least one exhaust pipe.

3. The method according to claim 1, wherein said step of providing at least one liquid removal element comprises at least one suction box.

4. The method according to claim 1, wherein said step of providing at least one liquid removal element comprises at least one dewatering trough.

5. The method according to claim 1, wherein said step of regulating of the dosage of said washing chemical is further regulated by means of a regulating device.

6. The method according to claim 5, wherein said regulating device further comprises a valve element for adjusting an operating speed of a feed pump.

7. The method according to claim 1, wherein said step of regulating of the dosage of said washing chemical is further controlled by a control unit.

8. The method according to claim 7, wherein said step of regulating of the dosage of said washing chemical is regulated manually by the control unit.

9. The method according to claim 7, wherein said step of regulating of the dosage of said washing chemical is regulated automatically by the control unit.

10. An apparatus for washing a fabric in a paper machine comprising:

means for passing a washing fluid to said fabric, said washing fluid having a dosage of washing chemical therein;

liquid removal means for removing a quantity of said washing fluid from said fabric at least at one point;

measuring devices for measuring said quantity washing fluid removed from said fabric at said at least one point;

a control unit for controlling the dosage of washing chemical provided in said washing fluid, said control unit being in communication with said measuring devices; and regulation means for regulating the dosage of the washing chemical provided in said washing fluid based on said measurement of said quantity of washing fluid removed from said fabric.

11. The apparatus according to claim 10, further comprises at least one set of means for moving said fabric.

12. The apparatus according to claim 10, wherein said fabric comprises felt or wire.

13. The apparatus according to claim 10, wherein said liquid removal element further comprises at least one exhaust pipe.

14. The apparatus according to claim 13, wherein said at least one exhaust pipe comprises at least one slit over said fabric.

15. The apparatus according to claim 10, wherein said liquid removal element further comprises at least one suction box.

16. The apparatus according to claim 15, wherein said at least one suction box comprises at least one slit over said fabric.

17. The apparatus according to claim 10, wherein said liquid removal element further comprises a dewatering trough.

18. The apparatus according to claim 17, wherein said dewatering trough being connected to an exhaust pipe.

19. The apparatus according to claim 17, wherein said dewatering trough being connected to a suction box.

20. The apparatus according to claim 10, wherein said regulation means further comprises a valve element for adjusting an operating speed of a feed pump.

* * * * *